US007560631B1

(12) United States Patent
John et al.

(10) Patent No.: US 7,560,631 B1
(45) Date of Patent: Jul. 14, 2009

(54) BRASS-WIND MUSICAL INSTRUMENT MOUTHPIECE

(76) Inventors: David John, 2731 N. Diane Cir., Mesa, AZ (US) 85203; John Eth, 2263 S. 173rd La., Goodyear, AZ (US) 85338

( * ) Notice: Subject to any disclaimer, the term of this patent is extended or adjusted under 35 U.S.C. 154(b) by 95 days.

(21) Appl. No.: 11/740,802

(22) Filed: Apr. 26, 2007

Related U.S. Application Data

(60) Provisional application No. 60/745,722, filed on Apr. 26, 2006.

(51) Int. Cl.
*G10D 9/02* (2006.01)

(52) U.S. Cl. ..... 84/398

(58) Field of Classification Search ..... 84/387 R, 84/298, 299, 398, 399
See application file for complete search history.

(56) References Cited

U.S. PATENT DOCUMENTS 5,353,673 A 10/1994 Lynch
5,969,280 A 10/1999 Marcinkiewicz
2005/0120861 A1* 6/2005 Love ..... 84/398

* cited by examiner

*Primary Examiner*—Kimberly R Lockett
(74) *Attorney, Agent, or Firm*—Schmeiser, Olsen & Watts, LLP

(57) ABSTRACT

A brass-wind musical instrument mouthpiece comprises: a cup comprising a rim and an inner rounded surface in communication with a bore in communication with a counter bore in communication with a backbore. An alternate embodiment comprises: a first portion comprising a cup in communication with a bore in communication with a counter bore and a first coupling portion; a second portion comprising a backbore and a second coupling portion; wherein the coupling portions are coupled together. A brass-wind musical instrument mouthpiece kit comprises: a plurality of first portions comprising first portions, in a variety of shapes and sizes, comprising a cup in communication with a bore in communication with a counter bore and a first coupling portion; a plurality of second portions, in a variety of shapes and sizes, comprising a backbore and a second coupling portion; and wherein any first portion may be coupled to any second portion.

7 Claims, 1 Drawing Sheet

BRASS-WIND MUSICAL INSTRUMENT MOUTHPIECE

1. PRIORITY

This application claims priority to U.S. Provisional Application Ser. No. 60/745,722, filed Apr. 26, 2006, by David John and John Eth and entitled "BRASS-WIND MUSICAL INSTRUMENT MOUTHPIECE", which is incorporated herein by reference in its entirety.

BACKGROUND OF THE INVENTION

1. Technical Field

This invention relates to an improved mouthpiece for brass-wind instruments.

2. Background Art

The family of brass-wind instruments includes trumpets, trombones, baritones, tubas, French horns, and other similar instruments. Most brass instruments are characterized, among other things, by having a cupped metal mouthpiece. A brass-wind musical instrument mouthpiece is typically composed of metal and comprises a cup, a bore, and a backbore. The cup of a typical mouthpiece comprises a rounded inner surface, against which a brass musician presses his or her lips when playing the instrument. As the musician blows air into the cup of the mouthpiece while applying pressure, the musician's lips vibrate, causing the air in the instrument to vibrate and create sound. The airflow passes from the cup through the bore and backbore and into the instrument itself.

Different types of brass instrument typically use mouthpieces of different sizes and shapes. Musicians can also use various sizes and shapes of mouthpieces for each instrument. For example, a trumpet player can use different mouthpieces on his or her trumpet, each having different bore diameters, cup shapes, etc.

The size and shape of the mouthpiece components greatly affect the tonal quality that the instrument produces. The size and shape also affect the difficulty level of playing the instrument.

One difficulty associated with playing brass instruments is playing high notes. To do so, the musician must have a strong embouchure (lip muscles and positioning). Even then, playing high notes for a long period fatigues the musician's lips, thus decreasing his or her ability to continue playing the instrument.

Accordingly, what is needed is an invention that allows brass instrument musicians to be able to play high notes more easily, thus allowing less skilled musicians to play higher notes than they otherwise would be able to, and also allowing all brass instrument musicians to be able to play for longer periods with less fatigue.

DISCLOSURE OF THE INVENTION

The present invention may be readily and easily adapted to a variety of brass instruments. Embodiments of the present invention may provide, among other benefits: the ability of the musician to play higher notes with increased ease.

In particular embodiments, the invention provides an improved mouthpiece that comprises a counter bore positioned between the bore and the backbore. The counter bore amplifies the sound prior to entering the backbore. The counter bore further has a diameter that is greater than the bore and smaller than, greater than or equal to the backbore.

The foregoing and other features and advantages of the invention will be apparent to those of ordinary skill in the art from the following more particular description of the invention and the accompanying illustrations.

BRIEF DESCRIPTION OF THE DRAWINGS

The invention will hereinafter be described in conjunction with the appended illustrations.

DESCRIPTION OF THE INVENTION

Embodiments of the present invention relate to an improved mouthpiece for brass instruments. Generally, an improved mouthpiece for brass instruments configured according to an embodiment of the present invention may comprise a cup, a bore, a chamber, and a backbore.

Figure 1:
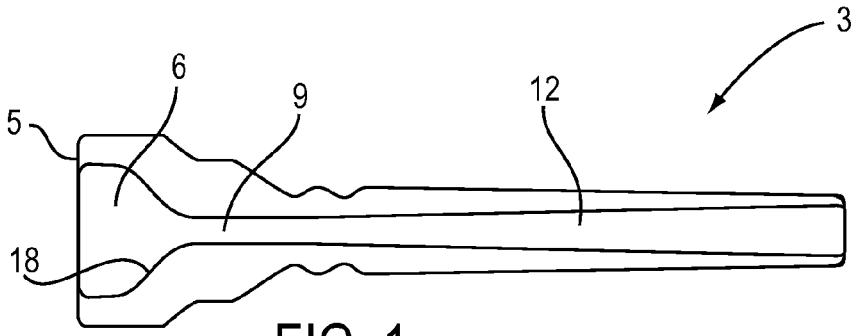
FIG. 1 is an illustration of a cross-sectional view of a typical trumpet mouthpiece, provided for background information.

FIG. 1 depicts a typical trumpet mouthpiece 3. As illustrated in FIG. 1, a typical trumpet mouthpiece 3 comprises a cup 6, a bore 9 (also called a throat), and a backbore 12. Mouthpieces of other brass instruments similarly comprise a cup 6, a bore 9, and a backbore 12. The cup 6 further comprises a rim 15 and an inner rounded surface 18. The inner rounded surface 18 narrows into the bore 9. The bore 9 is generally defined by a relatively narrow cylindrical shape between the cup 6 and the backbore 12. The backbore 12 is generally defined by a cylindrical channel that gradually flares wider going away from the cup 3.

An air-flow path is generally defined as a path through which air having a vibration created by the vibration of the musician's lips while the musician blows through the mouthpiece 3 will pass. The air-flow passes from the cup through the bore and backbore and into the instrument itself. In a typical brass mouthpiece 3, the air-flow path passes through the cup rim 15, past the inner rounded surface 18, through the bore 9, through the backbore 12, and into the instrument itself.

Variations in mouthpieces 3 typically include changes in: the size of diameter of the bore 9, the shape and size of the cup 6, the thickness of the rim 15, and other similar changes. Typically, larger brass instruments have mouthpieces 3 with larger corresponding cups 6, bores 9, and backbores 12.

Figure 2:
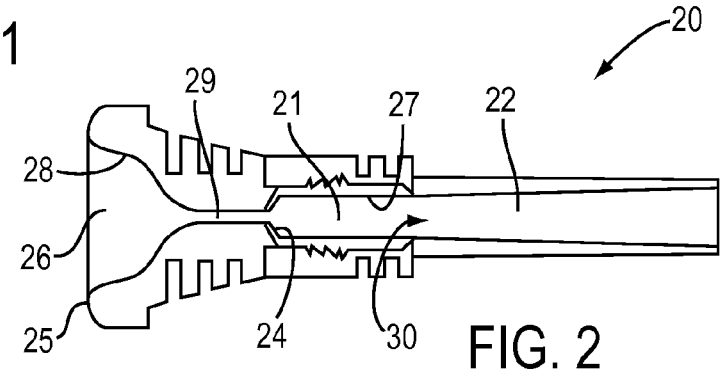
FIG. 2 is an illustration of a cross-sectional view of an embodiment of the present invention.
Figure 3:
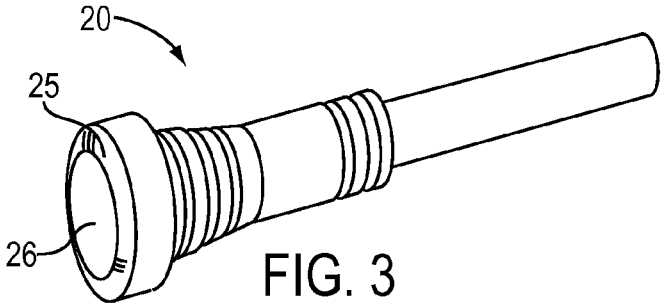
FIG. 3 is an illustration of a perspective view of an embodiment of the present invention.

FIGS. 2 and 3 depict a mouthpiece 20 according to a first embodiment of the present invention. As illustrated in FIGS. 2 and 3, embodiments of the present invention comprise components of a brass-wind mouthpiece 20 including cup 26, a bore 29, and a backbore 22. The cup 26 further comprises a rim 25 and an inner rounded surface 28. The mouthpiece 20 of the present invention further comprises a counter bore 21. The counter bore 21 is generally a chamber in the mouthpiece located between the bore 29 and the backbore 22. The cup 26 is in fluid communication with the bore 29 which is in fluid communication with the counter bore 21 which is in fluid communication with the backbore 22. In the first embodiment of the present invention, the air-flow path passes from the bore 29 to the counter bore 21, and then passes to the backbore 22.

The counter bore 21 comprises a flanged widening section 24 and a cylindrical section 27. In the widening section 24, the cross-sectional area of the air-flow path gradually increases until its cross-sectional area is roughly equal to that of the cylindrical section 27 before the air-flow path exits the counter bore 21 and enters the backbore entrance 30 of the backbore 22.

In alternate embodiments of the present invention, the counter bore 21 comprises no flanged sections, but only a sudden enlargement in diameter size. Alternate embodiments of the present invention comprise any combination of flanged or sudden widening and narrowing sections. Further the cross-sectional shape of the counter bore 21 may be of any shape and size, so long as the diameter of a portion of the counter bore 21 is greater than bore 29, while still being smaller than, greater than or equal to the diameter of the backbore entrance 30 of the backbore 22.

The counter bore 21 cross-sectional size and length may be the size and length that best produces the desired tonal and/or pitch qualities. It is understood that variations in virtually all portions of a brass-wind instrument mouthpiece may vary the tonal and pitch qualities. The mouthpiece 20 may have a cup 26 that varies in size and depth. The bore 29 may vary in size and length. The backbore 22 may vary in size, length and shape. Each variation to the mouthpiece 20 affects the tonal and pitch quality. For example, and not as a limitation, enlarging the bore 29 allows the user to pass a greater volume of air through the mouthpiece 20. The passing of a greater volume of air through the mouthpiece may allow the user to play louder without distortions of sound. Similarly, the size and length of the counter bore 21 may be adjusted in order to produce the desired sound qualities. The optimal size of the counter bore 21 will depend on the instrument for which the mouthpiece 20 is intended, as well as the particular user of the mouthpiece 20.

Alternate embodiments of the present invention comprise mouthpieces 20 of the proper size and shape for any brass instrument. It is to be understood that the invention covers any brass-wind musical instrument mouthpiece that comprises a counter bore 21. The cup 26 shape and size, the rim 25 shape and size, and the bore 29 size could all be altered in a mouthpiece that still falls under the scope of the present invention if it comprises a counter bore 21 or similar chamber.

The purpose of the counter bore 21 is to amplify the sound prior to entering the backbore 22. This amplification enables the user the ability to reach higher notes with increased ease, while maintaining the same feel of a conventional mouthpiece.

For the exemplary purposes of this disclosure, the components defining any embodiment of the invention may be composed of any of many different types of materials or combinations thereof that can readily be formed into shaped objects provided that the components selected are consistent with the intended operation of the invention. For example, the mouthpiece 20 may be formed of composites such as carbon-fiber and/or other like materials, polymers such as plastic, nylon, metals, alloys, and/or other like materials, any other suitable material, and/or any combination thereof.

Figure 4:
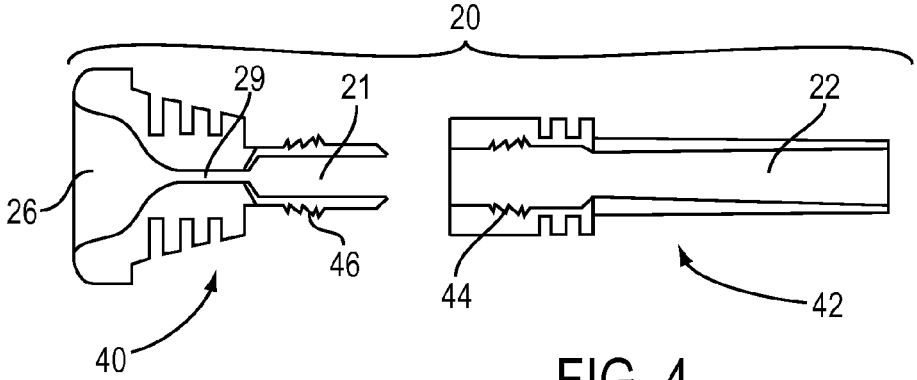
FIG. 4 is an illustration of a cross-sectional exploded view of an embodiment of the present invention.

Referring further to the drawings, FIG. 4 depicts an exploded cross-sectional view of a mouthpiece 20, in accordance with embodiments of the present invention. The mouthpiece 20 may comprise a first portion 40 and a second portion 42. The first portion 40 may comprise a cup 26, a bore 29, a counter bore 21 and a first coupling portion 46. The cup 26 is in fluid communication with the bore 29 and which is in fluid communication with the counter bore 21. A first coupling portion 46 is coupled to the counter bore 21. The second portion 42 may comprise the back bore 22 coupled to a second coupling portion 44, wherein the second coupling portion 44 is configured to receive and couple to the first coupling portion 46. It will be understood that the coupling portions 44 and 46 may be a removably coupled together utilizing couplings including, but not limited to threads, press fit, clamps, clips, and the like. In other particular embodiments the coupling may more permanent, such as, but not limited to, welding and adhesives.

The coupling portions 44 and 46 allowing for the first and second portions 40 and 42 respectively to be removably coupled together allows for the various combinations to be created of cup 26 shape and size, bore 29 shape and size, counter bore 21 shape and size and backbore 22 shape and size. Variations of the first portion 40 may be coupled with variations of the second portion 42 to achieve the desired sound and feel for each particular user. It is also contemplated that in particular embodiments of the mouthpiece 20, the mouth piece may be sold in a kit wherein a plurality of first portions 40 and second portions 42 are provided for the user to adjust as needed dependent on the music being played or the skill and desired feel of the user.

Figure 5:
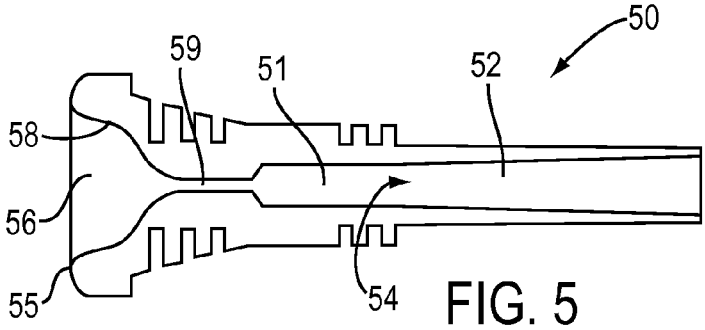
FIG. 5 is an illustration of a cross-sectional view of another embodiment of the present invention.

Referring further to the drawings, FIG. 5 depicts a brass-wind musical instrument mouthpiece 50, in accordance with the present invention. The mouthpiece 50 may comprise a cup 56, a bore 59, a backbore 52 and a counter bore 51. The cup 56 further comprises a rim 55 and an inner rounded surface 58. The counter bore 51 may be formed integral with the mouthpiece 50 such that the counter bore 51 diameter is equal to or smaller than the diameter of the backbore entrance 54 of the backbore 52. The mouthpiece 50 may then be formed as a single integral mouthpiece 50 without the need to couple together portions of a mouthpiece. In accordance with such embodiments of the present invention, the mouthpiece 50 may be adaptable to all sizes and types of brass-wind instruments and may be further modified for each specific user.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A brass-wind musical instrument mouthpiece comprising:

a cup, wherein the cup further comprises a rim and an inner rounded surface;

a bore in fluid communication with the cup;

a counter bore in fluid communication with the bore, wherein the counter bore further comprises a flanged widening section and a cylindrical section; and a backbore in fluid communication with the counter bore.

2. The brass-wind musical instrument mouthpiece of claim 1, wherein the counter bore amplifies sound produced by a user's lips vibrating while blowing on the brass-wind musical instrument mouthpiece prior to the sound entering the backbore.

3. The brass-wind musical instrument mouthpiece of claim 1, wherein the size of the cup may vary to produce different tonal and pitch qualities.

4. The brass-wind musical instrument mouthpiece of claim 1, wherein the counter bore may vary in size and length to produce desired tonal or pitch qualities.

5. The brass-wind musical instrument mouthpiece of claim 1, wherein the backbore may vary in size, length and shape to produce different tonal and pitch qualities.

6. The brass-wind musical instrument mouthpiece of claim 1, wherein the bore may be enlarged to allow the user to play louder.

7. The brass-wind musical instrument mouthpiece of claim 1, wherein the counter bore comprises a sudden enlargement in diameter size.

* * * * *